US008556837B1

(12) United States Patent
Poirier

(10) Patent No.: US 8,556,837 B1
(45) Date of Patent: Oct. 15, 2013

(54) THERAPEUTIC ROLLER APPARATUS

(75) Inventor: Christopher J. Poirier, North Kingstown, RI (US)

(73) Assignee: M-F Athletic Company, Inc., Cranston, RI (US)

( * ) Notice: Subject to any disclaimer, the term of this patent is extended or adjusted under 35 U.S.C. 154(b) by 324 days.

(21) Appl. No.: 12/862,884

(22) Filed: Aug. 25, 2010

Related U.S. Application Data

(60) Provisional application No. 61/236,915, filed on Aug. 26, 2009.

(51) Int. Cl.
*A61H 1/00* (2006.01)

(52) U.S. Cl.
USPC ..... 601/46

(58) Field of Classification Search
USPC ..... 601/46, 56, 57, 58, 60, 63, 66, 67, 68, 601/69, 70, 72, 73, 84, 94, 97, 99, 101, 102, 601/115, 118, 121, 126, 134, 136, 59
See application file for complete search history.

(56) References Cited

U.S. PATENT DOCUMENTS

| | | | | |
|---|---|---|---|---|
| 2,461,413 | A * | 2/1949 | Dirand | 601/120 |
| 2,939,455 | A * | 6/1960 | Arnold | 601/127 |
| 2,943,621 | A * | 7/1960 | Phillips et al. | 601/57 |
| 3,970,078 | A * | 7/1976 | Rogers, Jr. | 601/125 |
| 4,136,867 | A * | 1/1979 | Wilkin | 482/132 |
| 4,699,126 | A * | 10/1987 | Lancaster | 601/99 |
| 5,554,102 | A * | 9/1996 | Chiou | 601/72 |
| 5,637,065 | A * | 6/1997 | Chang | 482/114 |
| 5,830,161 | A * | 11/1998 | Cosmano | 601/121 |
| 6,647,572 | B2 | 11/2003 | Lee | |
| 7,137,926 | B2 | 11/2006 | Barrows | |
| 7,285,101 | B2 | 10/2007 | Tumey | |
| 2004/0267173 | A1* | 12/2004 | Mangano | 601/57 |
| 2008/0018167 | A1* | 1/2008 | Fuji | 301/5.23 |
| 2008/0070210 | A1 | 3/2008 | Hitzmann | |
| 2008/0255477 | A1 | 10/2008 | Woggon et al. | |
| 2010/0113992 | A1* | 5/2010 | Godfrey et al. | 601/70 |

FOREIGN PATENT DOCUMENTS

| | | |
|---|---|---|
| WO | 92/00053 | 1/1992 |

* cited by examiner

*Primary Examiner* — Patricia Bianco
*Assistant Examiner* — Raymond E Harris
(74) *Attorney, Agent, or Firm* — Salter & Michaelson

(57) ABSTRACT

A therapeutic roller apparatus that includes a rigid plastic roller member and a soft foam material sleeve that is adapted to fittingly mount about the rigid plastic roller member. The rigid plastic roller member preferably also has an inner tubular passage for fittingly receiving a vibration assembly. The vibration assembly includes, inter alia, an energy driven motor, preferably driven from an array of batteries and a weight that is coupled with the motor. The weight and motor together, when operated, provide a vibratory effect that is transferred through to the outer soft foam material sleeve.

11 Claims, 5 Drawing Sheets

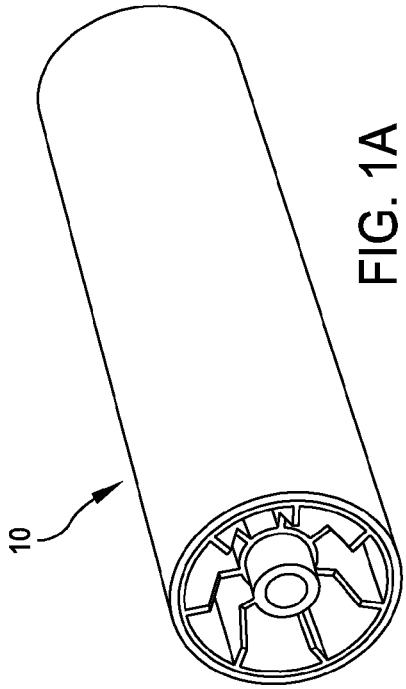
FIG. 1A
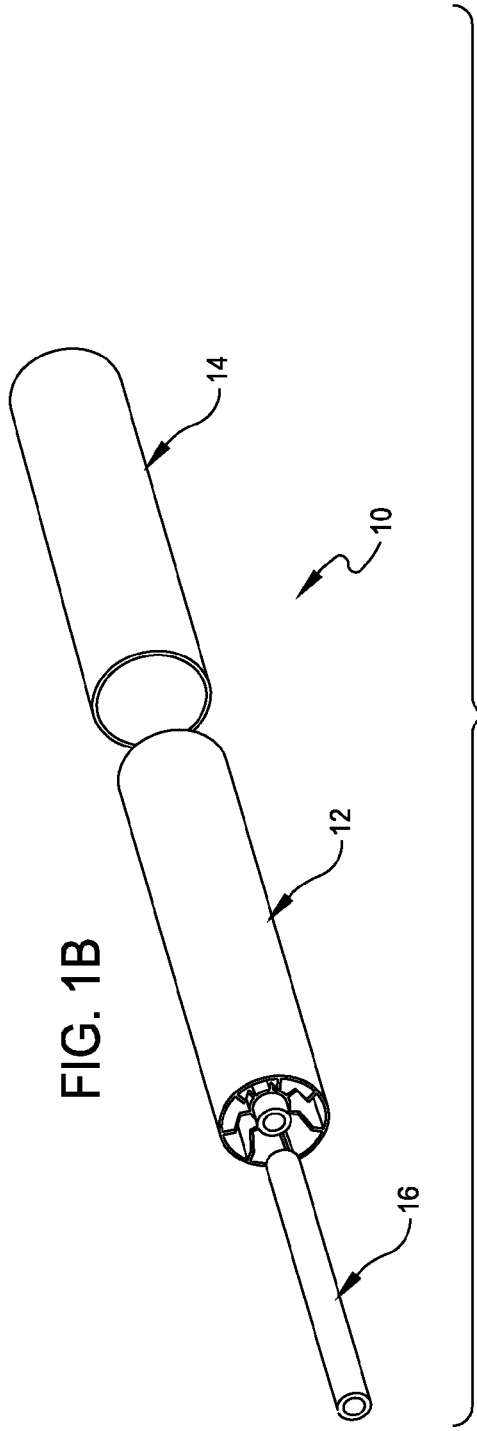
FIG. 1B
FIG. 1

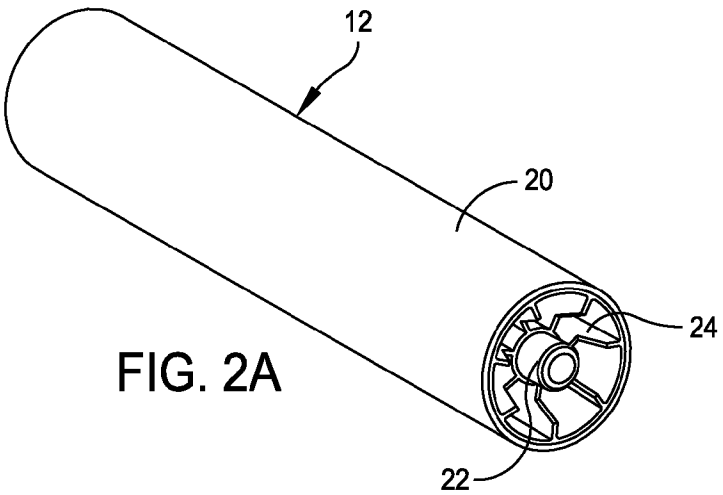
FIG. 2A
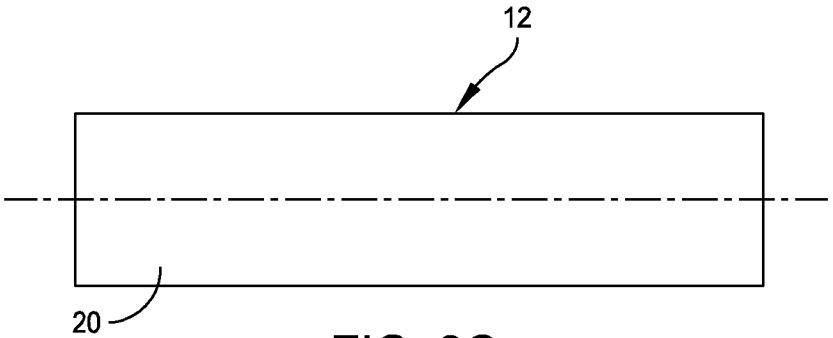
FIG. 2C
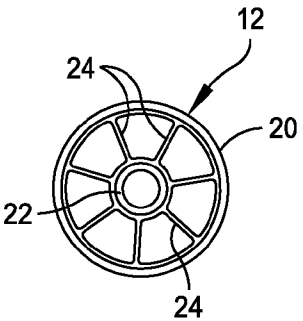
FIG. 2B
FIG. 2

THERAPEUTIC ROLLER APPARATUS

RELATED CASE

Priority for this application is hereby claimed under 35 U.S.C. §119(e) to commonly owned and U.S. Provisional Patent Application No. 61/236,915 which was filed on Aug. 26, 2009 and which is incorporated by reference herein in its entirety.

TECHNICAL FIELD

The present invention relates in general to a therapeutic roller apparatus and pertains, more particularly, to an apparatus that provides enhanced therapeutic action for such applications, but not limited to, balance training, self-massage and stretching.

BACKGROUND AND SUMMARY OF THE INVENTION

At the present time, foam rollers exist. These are commonly used for such purposes as balance training, self-myofascial release, self-massage and stretching. Such foam rollers may also be used for golf swing practice, yoga and Pilates. These rollers may be provided in full cylindrical shape as well as a half-round foam roller version. These rollers can also be provided in various diameters and lengths.

It is an object of the present invention to improve the application of these rollers by incorporating a vibrating means therein. Thus, in accordance with one aspect of the present invention there is provided a therapeutic roller apparatus that comprises a rigid plastic roller member and a soft foam material sleeve that is adapted to fittingly mount about the rigid plastic roller member. The rigid plastic roller member preferably also has an inner tubular passage for fittingly receiving a vibration assembly. The vibration assembly includes, inter alia, an energy driven motor, preferably driven from an array of batteries and a weight that is coupled with the motor. The weight and motor together, when operated, provide a vibratory effect that is transferred through to the outer soft foam material sleeve.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which:

FIGS. 1A-B is an exploded perspective view showing the main components of the therapeutic roller apparatus of the present invention;

FIGS. 2A-C shows alternate views of the rigid plastic roller member of the present invention;

DETAILED DESCRIPTION

As indicated previously, rollers have been used for therapeutic purposes such as for balance training, self-myofascial release, self-massage and stretching. These rollers have also been used for golf swing practice, yoga and Pilates. The rollers of this type are sold by, for example, Perform Better of Cranston, R.I. These may be identified as EVA Foam Rollers or PB Elite Molded Foam Rollers. These rollers may be formed in various lengths depending upon the particular application for the roller and may also be formed in different diameters.

Now, in accordance with the present invention, there is provided an improved therapeutic roller apparatus and one in which a vibratory action supplements the roller action. The therapeutic roller apparatus of the present invention may also be provided in various diameters and lengths depending upon a particular application thereof.

Figure 3:
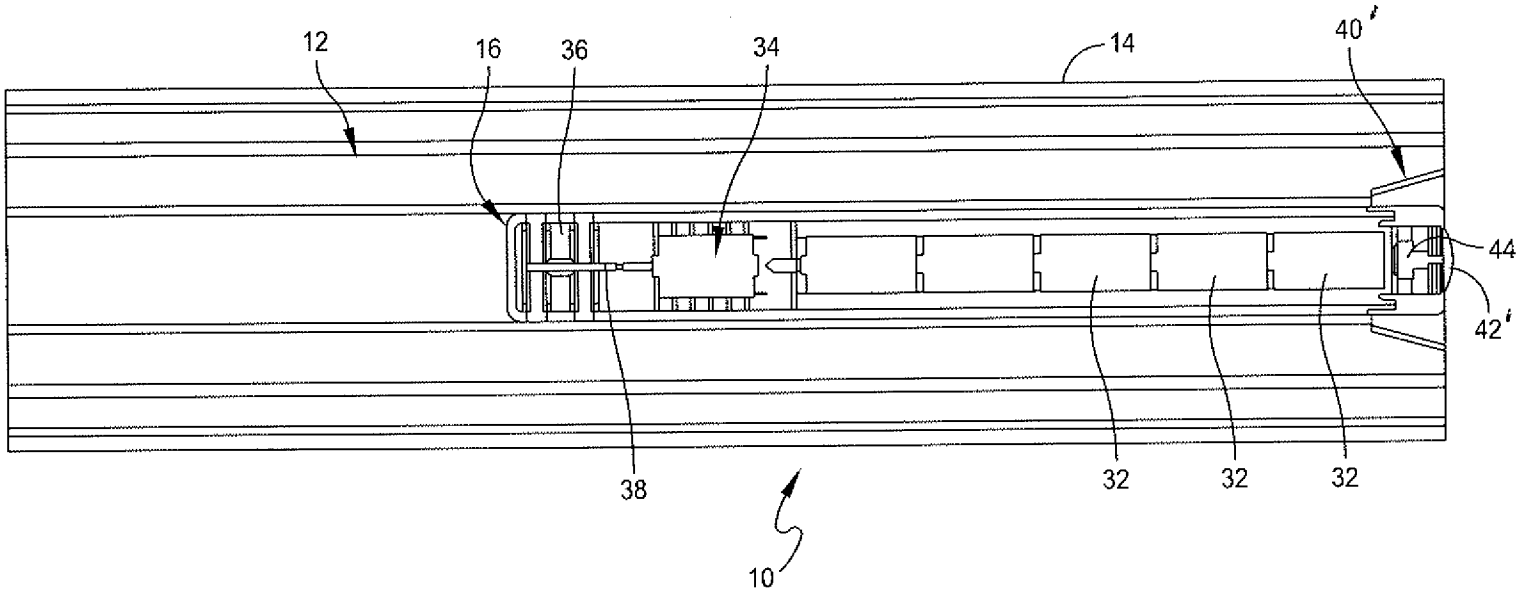
FIG. 3 is a cross-sectional view through an assemble apparatus illustrating the various components.

Reference is now made to the drawings for a preferred embodiment of the therapeutic roller apparatus of the present invention. In this regard, FIGS. 1A-B is an exploded perspective view showing the main components that comprise the roller apparatus while FIGS. 2A-C is an illustration of 30 the main roller member. Thus, in FIG. 1A the roller apparatus is shown at 10 in an assembled state. FIG. 1B also shows by an exploded view that the apparatus is comprised of a rigid plastic roller member 12, a soft foam material sleeve 14 and a vibration assembly 16. The soft foam material sleeve 14 is preferably a neoprene sleeve that is adapted to fittingly engage and mount about the rigid plastic roller member 12. The vibration assembly 16 is adapted to fittingly be 5 received within the rigid plastic roller member 12. FIG. 1B illustrates these components exploded away from each other while FIG. 3 is a cross-section illustrating the components in place. The neoprene sleeve 14 is sized so as to snugly fit over the roller member 12. An adhesive may be applied between the sleeve 14 and the member 12.

The rigid plastic roller member 12 is preferably constructed of a PVC extrusion. For details of the PVC extrusion refer to FIGS. 2A-C. Thus the PVC extrusion is formed of an outer tubular member 20, an inner tubular member 22 and a series of spokes 24 that interconnect the inner and outer tubular members. A cross-section of the extrusion is illustrated in FIG. 2B. The internal diameter of the inner tubular member 22 is dimensioned so as to fittingly receive the plastic vibration assembly 16. In FIG. 2B there are seven spokes 24. However, the number of spokes can be either greater or less than seven. Each of these spokes 24 extend radially from a center axis of the roller member between the inner and outer tubular members.

Figure 4:
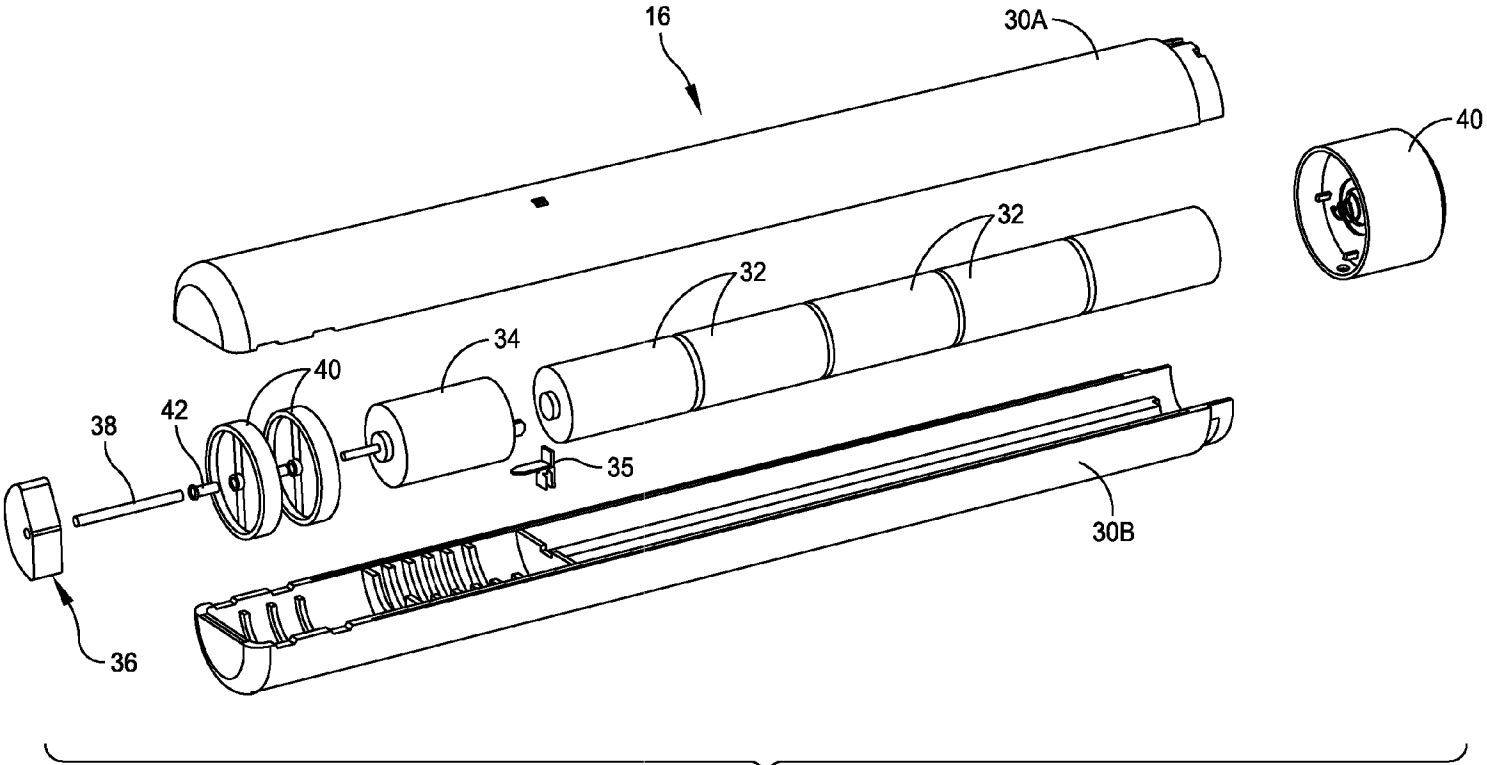
FIG. 4 is an exploded perspective view of the vibration assembly.
Figure 5:
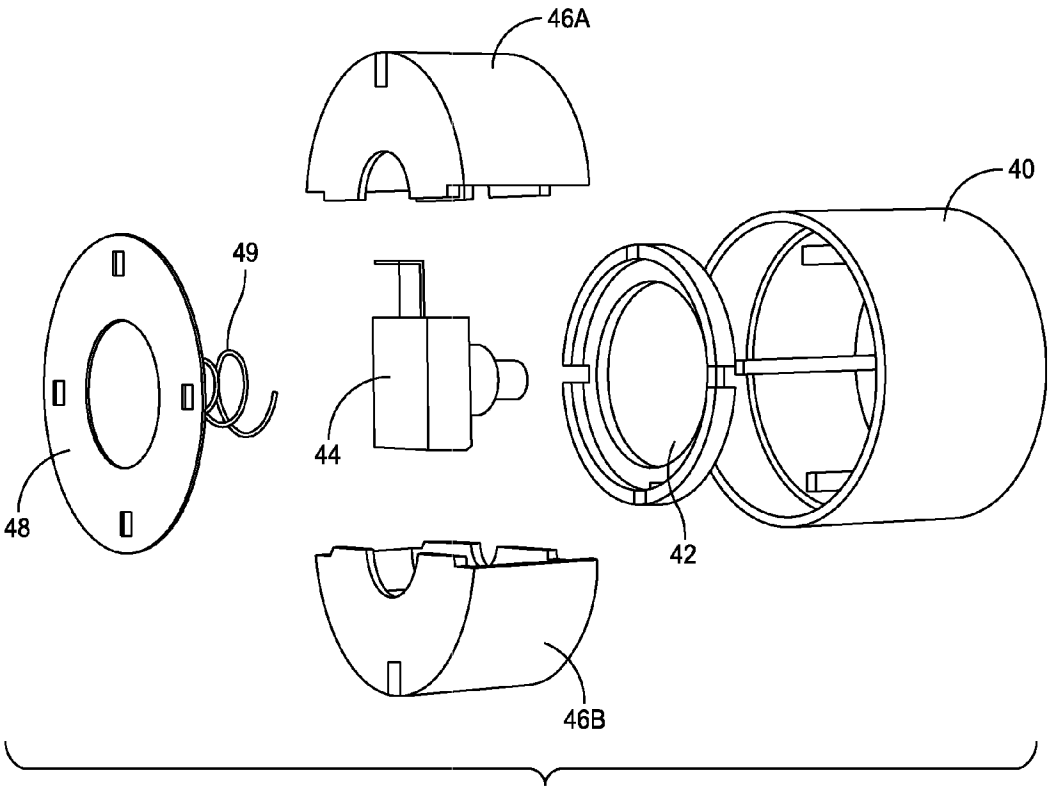
FIG. 5 is an exploded perspective view of the end switch mechanism.

Reference is now made to FIGS. 3-5 for further details, in particular, of the vibration assembly 16. FIG. 1B schematically illustrates the plastic vibration assembly 16 as a tubular member. For further details refer to the exploded perspective view of FIG. 4 which illustrates the tubular member as comprised of main body halves 30A, 30B. The plastic vibration assembly is meant to be pressed into the inner tubular member of the PVC extrusion 12. The vibration assembly includes, in addition to the main body, a series of batteries 32, a motor 34 and a weight 36. The motor 34 is coupled to the weight 36 for rotation thereof by means of the shaft 38. The main tubular body having a length less than the length of the rigid plastic roller member 12 so as to dispose the motor 34 that is within the main tubular body member substantially at a midpoint of the rigid plastic roller member 12.

FIG. 4 also illustrates the bushing holder 40 and a bushing 42 that is for support of the shaft 38. Again, the shaft 38 connects from an output shaft of the motor 34 to the weight 36. When the motor 34 is energized, then the shaft 38 rotates with the rotation of the motor and in turn the weight 36 is rotated. It is noted that the weight 36 has an off-center configuration. It is the combination of the motor drive along with the off-center weight that provides the vibration. FIG. 4 also shows a positive connector 35 which provides one of the electrical connections between the series of batteries 32 and the motor 34. As also illustrated in FIG. 4, the main body halves are provided with separate compartments that may be identified with ribs or ridges within the body so as to accommodate the various components. Again, FIG. 3 illustrates all of these components in place within the plastic vibration assembly.

Reference is now made to the exploded perspective view of FIG. 5 that shows the switch or cap assembly. This includes an end cap 40', button 42', switch 44, switch holders 46A, 46B, contact plate 48 and the battery spring 49. The switch 44 is preferably a two pole on/off switch. In that way, the user can hit the button once to turn the vibrator on and hit it a second time to turn the vibrator off. The spring 49 biases the switch to a more distal position.

Wiring (not shown) is used for connecting the motor with the cap assembly. For this purpose, the vibration assembly may be provided with grooves in which the wire can extend. Electrical contact between the batteries and the motor is also provided by the contact plate 48. The wiring would include a series circuit through the motor and the switch 44 with the switch 44 simply allowing or interrupting the current flow from the batteries to the motor.

As illustrated in FIG. 3, the vibrating mechanism is preferably disposed close to a midpoint along the roller apparatus. The control means for the vibrator, namely the switch 44 is preferably disposed at one end of the roller apparatus. In that way, a user has ready access to the operating switch by way of depressing the button 42'.

The use of a battery operated vibrator is particularly helpful in that there are no electrical lines that need to be run to the therapeutic roller device. Also of importance is the fact that the control portion of the device, in particular the switch 44, is disposed at an end of the roller apparatus and at a position where the button 42' is readily accessible for use.

In developing the therapeutic roller apparatus of the present invention, it has also been found important to provide a relatively rigid structure such as the PVC extrusion 12, between the vibration part of the device and the soft foam sleeve 14. By using a more rigid member 12, this enhances the vibrations caused by the motor and associated weight. Moreover, the spoke construction illustrated in the drawings has been found to be particularly advantageous in enhancing vibrations. At the same time, any contact with the user is at the sleeve 14 which is of a soft material preferably some type of a foam such as a neoprene sleeve.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A therapeutic roller apparatus comprising:

a rigid plastic roller member;

a soft foam material sleeve that is adapted to fittingly mount about said rigid plastic roller member;

only one off center axis weight;

a vibration assembly including an energy driven motor coupled with said off center axis weight that together, when operated, provides a vibratory effect at the soft foam material sleeve;

said rigid plastic roller member including an outer tubular member having a predetermined length, an inner tubular member having a predetermined length that is substantially the same as the length of the outer tubular member, and separate spoke pieces disposed respectively at opposite ends of the tubular members and each including a plurality of radially extending spokes having respective ends fixedly secured to the outer tubular member and the inner tubular member opposite ends and constructed and arranged so that the inner tubular member is coaxially disposed within and relative to the outer tubular member;

said vibration assembly including a main tubular body that is constructed and arranged to be fittingly received within the inner tubular member of the rigid plastic roller member, and that has inner ribs that separate the interior of the main body into separate compartments;

wherein the main tubular body of the vibration assembly includes a pair of semicircular main body halves that are joined to form the separate compartments and that have respective one and other ends;

said main body halves having an enclosing end cap at the one end thereof adjacent to the off center axis weight and for enclosing the off center axis weight;

said main tubular body having a length less than the length of the rigid plastic roller member so as to dispose the motor that is within the main tubular body member substantially at a midpoint of the rigid plastic roller member;

said vibration assembly further including a shaft that intercouples the weight and motor, a plurality of series connected batteries, and a switch assembly for selectively operating the motor;

at least one bushing disposed in the main body and a bushing holder for supporting the bushing from the shaft;

said bushing holder received between the main body halves, supported on the vibration assembly shaft and disposed between the motor and off center axis weight;

said switch assembly including an end cap disposed at the other end of the main tubular body, a switch, a switch holder, and a switch actuation button comprised of a two pole on/off switch having a first selected position hit to turn the motor on and a second selected position subsequently hit to turn the motor off.

2. The therapeutic roller apparatus of claim 1 wherein the ribs include ribs for supporting the bushing holder.

3. The therapeutic roller apparatus of claim 2 wherein separate compartments are defined by a rib that separates a battery compartment from a motor and weight compartment.

4. The therapeutic roller apparatus of claim 1 wherein the weight has a center hole therein and an off center weight distribution.

5. The therapeutic roller apparatus of claim 4 including a pair of bushings and associated bushing holders.

6. The therapeutic roller apparatus of claim 5 wherein the series connected batteries are disposed adjacent to the switch assembly end cap.

7. The therapeutic roller apparatus of claim 6 wherein the bushings support the shaft and are spacedly disposed between each other and also spacedly arranged between the motor and weight.

8. The therapeutic roller apparatus of claim 7 wherein the weight is spacedly disposed relative to the end cap along the shaft.

9. The therapeutic roller apparatus of claim 8 wherein the switch holder includes holder halves.

10. The therapeutic roller apparatus of claim 9 wherein the switch assembly also includes a contact plate and spring for biasing the switch to a more distal position.

11. The therapeutic roller apparatus of claim 1 wherein the soft foam material sleeve comprises a neoprene sleeve.

* * * * *